US008833886B2

(12) United States Patent
Kanaya et al.

(10) Patent No.: US 8,833,886 B2
(45) Date of Patent: Sep. 16, 2014

(54) PRETREATMENT METHOD FOR PRINTING MATERIAL, PRETREATMENT DEVICE, INK JET TEXTILE PRINTING APPARATUS AND INK JET TEXTILE PRINTING METHOD

(75) Inventors: Nobuhiro Kanaya, Matsumoto (JP); Shinichi Kamoshida, Saitama (JP); Takuya Fujita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 13/612,666

(22) Filed: Sep. 12, 2012

(65) Prior Publication Data

US 2013/0076814 A1 Mar. 28, 2013

(30) Foreign Application Priority Data

Sep. 26, 2011 (JP) ..... 2011-209185

(51) Int. Cl.

| | |
|---|---|
| ***B41J 29/38*** | (2006.01) |
| ***B41J 11/00*** | (2006.01) |
| ***D06P 5/30*** | (2006.01) |
| ***B41J 3/407*** | (2006.01) |
| *B41M 5/00* | (2006.01) |

(52) U.S. Cl.

CPC ..... *D06P 5/30* (2013.01); *B41M 5/0047* (2013.01); *B41J 11/0015* (2013.01); *B41M 5/0064* (2013.01); *B41M 5/0011* (2013.01); *B41J 3/4078* (2013.01)

USPC ..... 347/9; 347/104

(58) Field of Classification Search

USPC ..... 347/5, 9, 14, 16, 21, 101, 104–107

See application file for complete search history.

(56) References Cited

U.S. PATENT DOCUMENTS

| | | | | |
|---|---|---|---|---|
| 6,908,190 | B2 * | 6/2005 | Iwatsuki et al. | 347/104 |
| 2007/0040879 | A1 * | 2/2007 | Chung et al. | 347/96 |

FOREIGN PATENT DOCUMENTS

| | | |
|---|---|---|
| JP | 2009-209493 | 9/2009 |

* cited by examiner

*Primary Examiner* — Juanita D Jackson

(74) *Attorney, Agent, or Firm* — Workman Nydegger

(57) ABSTRACT

A pretreatment method for a printing material is performed prior to ink jet textile printing on the printing material and includes the steps of imparting a tension force to at least a printing area of the printing material on which ink jet textile printing is performed so as to put the printing area in a tensioned state, and applying a pretreatment agent having an ink permeation inhibiting property on the printing area in the tensioned state.

16 Claims, 13 Drawing Sheets

PRETREATMENT METHOD FOR PRINTING MATERIAL, PRETREATMENT DEVICE, INK JET TEXTILE PRINTING APPARATUS AND INK JET TEXTILE PRINTING METHOD

BACKGROUND

1. Technical Field

The present invention relates to a pretreatment method for a printing material for performing pretreatment on a fabric, that is, the printing material prior to performing ink jet printing on the printing material so as to inhibit ink from being permeated into the printing material, a pretreatment device, an ink jet textile printing apparatus and an ink jet textile printing method.

2. Related Art

Ink jet textile printing apparatuses have been developed and used which perform printing of a desired image by ejecting respective colors of ink from ink ejection head onto a surface of a fabric such as a T-shirt. JPA-2009-209493 discloses a technique to apply a pretreatment agent having an ink permeation inhibiting property and dry the pretreatment agent prior to performing printing by the ink jet textile printing apparatus as a pretreatment to inhibit ink from being permeated into the fabric, thereby forming an even permeation inhibiting layer on a printing surface of a fabric. This is performed in order to prevent ink from bleeding due to permeation into the fabric or being influenced by a color of the fabric to be printed.

The pretreatment to form a permeation inhibiting layer on the surface of the fabric is required especially in the case where white ink is printed on the surface of colored fabric. If white ink is ejected onto the surface of the fabric that does not have the permeation inhibiting layer formed thereon, the white ink is partially permeated into the fabric and is reduced in layer thickness. This causes the white ink to appear translucent, allowing the colored fabric to be seen therethrough, and not to appear as white.

In the conventional pretreatment method disclosed in JP-A-2009-209493, the pretreatment operation to apply the pretreatment agent on the surface of the fabric and dry the pretreatment agent is carried out on the fabric in its relaxed state with an external tension force not applied. As a result, as shown in FIG. 11A, the amount of a pretreatment agent M applied on concave portions 103 and convex portions 105 of the weaves of the fabric 101 often varies depending on where it is applied. Especially, as shown in FIG. 11B, cracks 111 may be formed at intermediate portions 107 between the concave portions 103 and the convex portions 105 due to the fabric 101 being pulled when set on the set tray 109 of the ink jet textile printing apparatus.

The variation in applied amount of the pretreatment agent M leads to uneven drying of the pretreatment agent M. Such variation causes a problem leading to decreased print quality in the ink jet textile printing apparatus. When the cracks 111 are formed, ink permeates into the fabric 101 through the cracks 111, resulting in problems such as bleeding of ink and influence by a color of the fabric to be printed. Particularly, in the case of white ink, those problems become significant.

SUMMARY

An advantage of some aspects of the invention is that a pretreatment layer having an even thickness and resistant to generation of cracks can be formed.

According to a first aspect of the invention, a pretreatment method for a printing material is performed prior to ink jet textile printing on the printing material. That is, the pretreatment method for a printing material includes the steps of imparting a tension force to at least a printing area of the printing material on which ink jet textile printing is performed, and applying a pretreatment agent having an ink permeation inhibiting property on the printing area in a state that the tension force is imparted.

The term "printing material" as used herein refers to a "fabric" on which textile printing is performed and includes woven fabric, knitted fabric, and non-woven fabric of natural fibers such as cotton, silk, wool, chemical fibers such as nylon, and composite fibers thereof in the form of a roll of fabric and cut in a predetermined length. In addition, the printing material further includes sewn clothes such as T-shirts, sewn products such as handkerchiefs, scarves, towels, furniture such as curtains, sheets, and bed covers, as well as cut and uncut pieces of fabric for sewn products. The term "ink jet textile printing" refers to printing of a desired image on a printing material by ejecting ink from an ink jet type ink ejection head.

Accordingly, the tension force is applied in the direction along the surface of the printing area of the printing material, thereby improving flatness of the printing area of the printing material, and a pretreatment layer having an ink permeation inhibiting property is formed on the printing area with improved flatness. As a consequence, evenness in thickness of the pretreatment layer formed on the printing area of the printing material can be improved. Further, occurrence of cracks at intermediate positions between concave portions and convex portions can be reduced. This can prevent ink from permeating into the printing material through the cracks and reduce problems such as bleeding of ink and influence by a color of the fabric to be printed during ink jet textile printing.

According to a second aspect of the invention, the pretreatment method for a printing material of the first aspect may further include the step of, after the applying the pretreatment agent, solidifying the pretreatment agent having an ink permeation inhibiting property which has been applied on the printing area in the state that the tension force is imparted. Solidification of the pretreatment agent includes solidification by thermal heating, solidification by natural drying, curing by light irradiation, and any other transition from the liquid state to the solid state. Further, the extent of solidification may be sufficient as long as it can function as a pretreatment layer. For example, in the case of thermal drying solidification, the pretreatment agent may not be completely dried.

Accordingly, solidification of the pretreatment agent is performed by solidifying the pretreatment agent after applying the pretreatment agent in a state that the tension force is applied to the printing area. As a consequence, shrinkage of the printing area after the pretreatment agent is applied on the printing area is reduced by solidification. This makes it possible to perform ink jet textile printing on the flat printing area, thereby improving the quality of printing.

According to a third aspect of the invention, a pretreatment device for a printing material is used prior to ink jet textile printing on the printing material. That is, the pretreatment device for a printing material may include a first set tray having a set surface on which the printing material is set and a tension force imparting unit that imparts a tension force to at least a printing area of the printing material on which ink jet textile printing is performed so as to put the printing area in a tensioned state, and a pretreatment agent applying unit that applies a pretreatment agent having an ink permeation inhibiting property on the printing area in the tensioned state. Accordingly, the same effect as that of the first aspect of the invention can be achieved.

According to a fourth aspect of the invention, an ink jet textile printing apparatus includes an ink ejection head that ejects ink, a second set tray having a set surface on which a printing material is set, the second set tray being detachably mounted on a connected member and performing a relative movement to the ink ejection head while being mounted on the connected member, and a control unit that controls at least one of operations of the ink ejection head and the relative movement, wherein the second set tray also serves as the first set tray of the pretreatment device of the third aspect when the first set tray is removed from the pretreatment device, and the control unit has a control mode to start ink jet textile printing by the ink ejection head when receiving information that indicates that a pretreatment agent having an ink permeation inhibiting property has been applied on a printing area in a tensioned state.

Accordingly, the second set tray for ink jet textile printing is configured to also serve as the first set tray when the first set tray used in the pretreatment device is removed from the pretreatment device. As a consequence, a pretreatment layer having an ink permeation inhibiting property can be formed on the printing area of the printing material with improved evenness in thickness, and ink jet textile printing by the ink ejection head can be performed on such a pretreatment layer. The control unit has a control mode to start ink jet textile printing by the ink ejection head when receiving information that indicates that the pretreatment agent having an ink permeation inhibiting property has been applied on the printing area in the tensioned state. Accordingly, when the ink jet textile printing apparatus is operated in the control mode, it is possible to reduce a risk of performing inefficient ink jet textile printing on the pretreatment layer formed on the printing material having uneven thickness and possible cracks.

According to a fifth aspect of the invention, an ink jet textile printing apparatus includes, an ink ejection head that performs ink jet textile printing on a printing material, a second set tray having a set surface on which a printing material is set, the second set tray performing a relative movement to the ink ejection head during performing ink jet textile printing, the pretreatment device of the third aspect configured such that the second set tray also serves as the first set tray, and a control unit that controls each operation of the ink ejection head, the relative movement, and the pretreatment device, wherein the control unit has a control mode to start ink jet textile printing by the ink ejection head after a pretreatment agent having an ink permeation inhibiting property is applied on a printing area in a tensioned state by the pretreatment device.

Accordingly, the ink jet textile printing apparatus includes the pretreatment device as a component thereof. The control unit has a control mode to start ink jet textile printing by the ink ejection head after the pretreatment agent having an ink permeation inhibiting property is applied on the printing area in the tensioned state by the pretreatment device. Accordingly, when the ink jet textile printing apparatus is operated in the control mode, it is possible to reduce a risk of performing inefficient ink jet textile printing on the pretreatment layer formed on the printing material having uneven thickness and possible cracks. In addition to that, it is possible to continuously perform the operations from pretreatment to ink jet textile printing by using a single set tray, thereby improving an operability of a user.

According to a sixth aspect of the invention, the ink jet textile printing apparatus of the fourth or fifth aspect may be configured to perform ink jet textile printing by the ink ejection head in a state that a tension force is applied to the printing area to the same extent as the tension force imparted to the printing area during application of the pretreatment agent.

Accordingly, since the extent of the tension force imparted to the printing area during pretreatment and during ink jet textile printing are substantially the same, ink jet textile printing to form a printing image can be performed while the tensioned state of the printing area remains substantially the same without applying a stress on the pretreatment layer, thereby further improving the quality of the printing on the printing material.

According to a seventh aspect of the invention, an ink jet textile printing method includes the step of, after the pretreatment method of the first or second aspect, performing ink jet textile printing on a printing area of a printing material on which a pretreatment agent has been applied.

Accordingly, ink jet textile printing can be performed on the printing material that has a good pretreatment layer having an even thickness and resistant to generation of cracks, thereby preventing ink from permeating into the printing material and improving the quality of printing image.

According to an eighth aspect of the invention, the performing ink jet textile printing of the seventh aspect may be carried out in a state that a tension force is applied to the printing area to the same extent as the tension force imparted to the printing area during application of the pretreatment agent. Accordingly, the same effect as that of the sixth aspect of the invention can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

Figure 1:
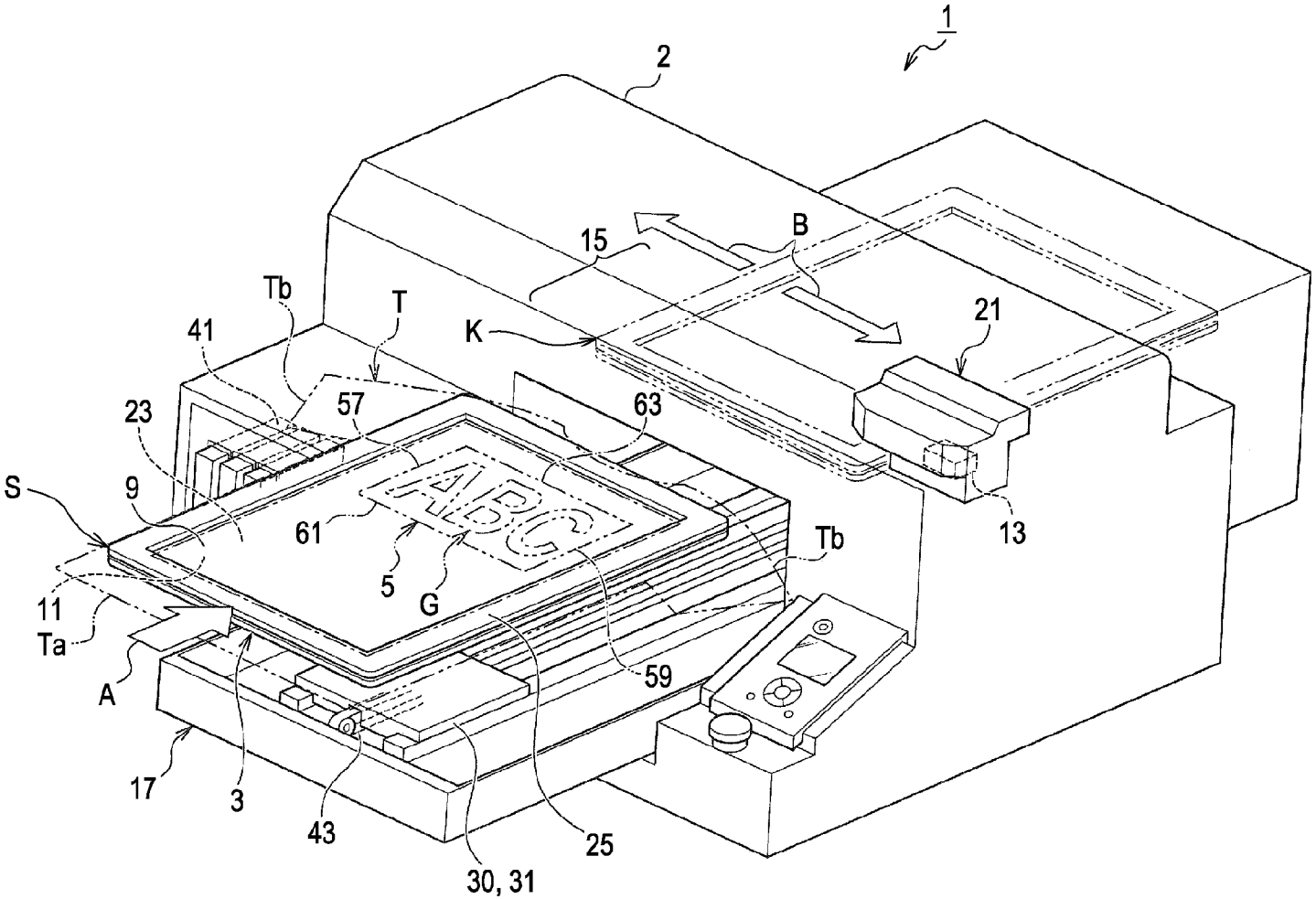
FIG. 1 is a perspective view which shows a schematic configuration of an ink jet textile printing apparatus according to an embodiment of the invention.
Figure 2:
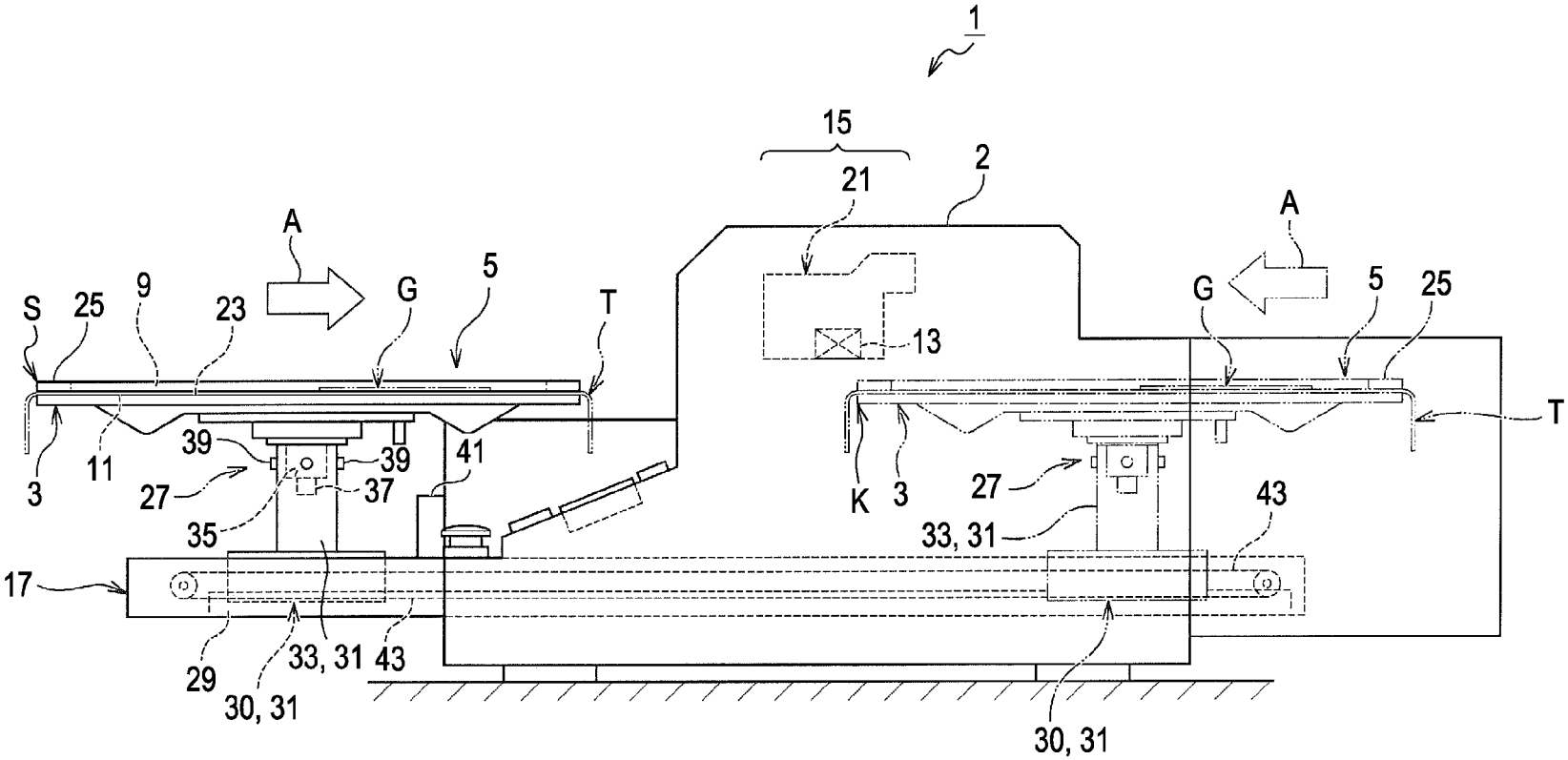
FIG. 2 is a side sectional view which shows a schematic configuration of the ink jet textile printing apparatus according to the embodiment of the invention.
Figure 3:
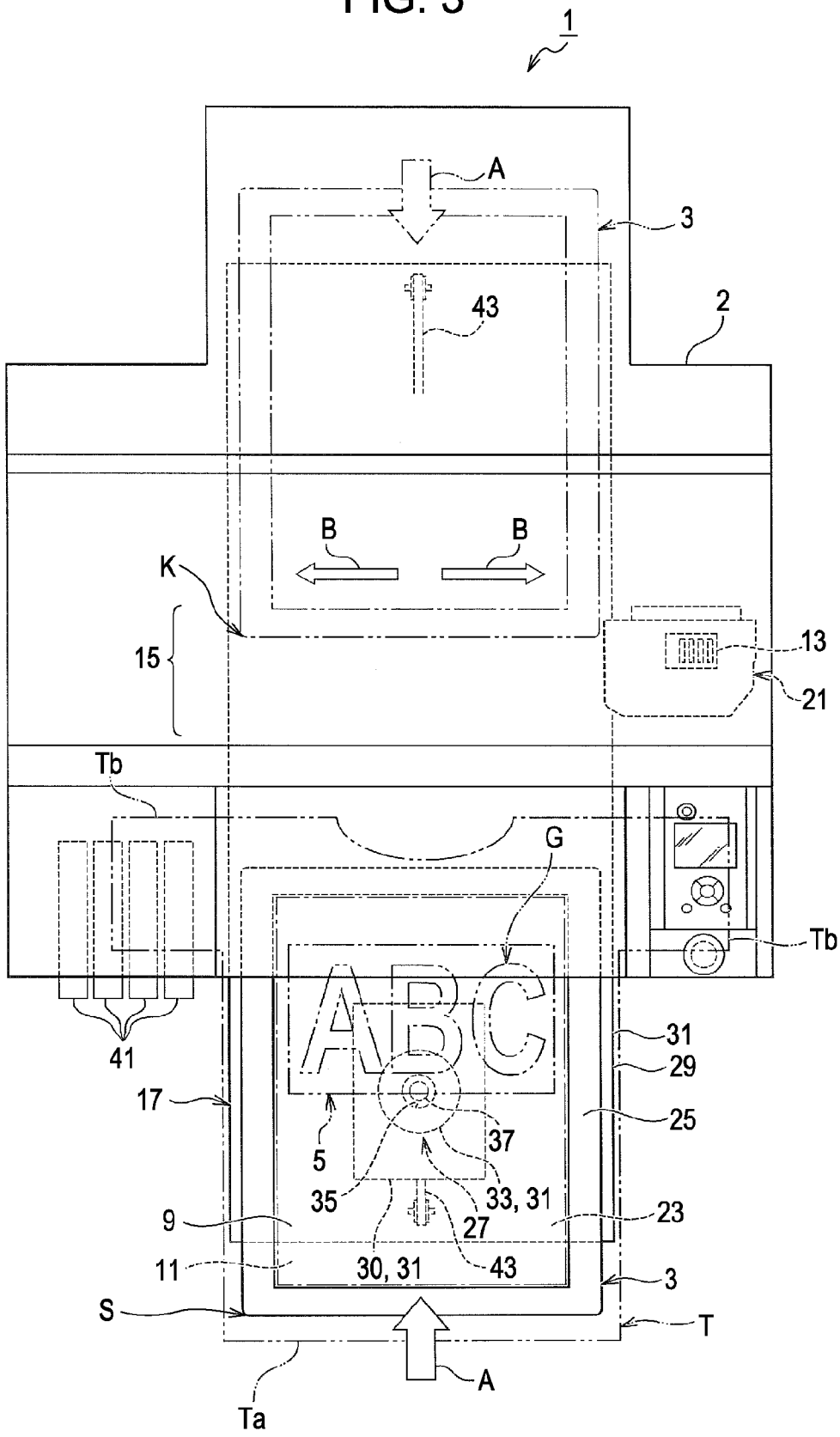
FIG. 3 is a plan view which shows a schematic configuration of the ink jet textile printing apparatus according to the embodiment of the invention.

First, a schematic configuration of an ink jet textile printing apparatus according to an embodiment of the invention will be described with reference to FIGS. 1 to 3. Next, a schematic configuration of a pretreatment device used in a pretreatment method for a printing material according to the invention will be described with reference to FIG. 8. In the following description, a printing material (hereinafter, also referred to as "fabric") T will be described by way of example of a T-shirt having a tubular torso Ta and sleeves Tb. The printing material T includes a first side 9 which is on the front side of the T-shirt on which a printing image G is formed and a second side 11 on the back side of the T-shirt which is opposite to the first side 9.

1. Schematic Configuration of the Ink Jet Textile Printing Apparatus (See FIGS. 1 to 3)

An ink jet textile printing apparatus 1 according to the invention is an ink jet type textile printing apparatus that forms the printing image G by ejecting ink onto the surface of the printing material T on which a pretreatment agent M (FIG. 8) having an ink permeation inhibiting property has been applied. The ink jet textile printing apparatus 1 includes a second set tray 3 having a set surface 23 on which the printing material T is set and a connection structure 27 used for detachably attaching the printing material T to a transportation unit 17, and an ink ejection head 13 that ejects respective colors of ink C onto a printing area 5 of the printing material T which is set on the second set tray 3.

The second set tray 3 is a rectangular plate member according to one example and is provided with the set surface 23 that extends over a large area at the center on the top surface of the second set tray 3 so as to support the printing material T while being directly in contact with the second side 11 of the printing material T. The second set tray 3 is configured so that a frame body 25 can be fitted therearound. When fitted around the second set tray 3, the frame body 25 serves to set the printing material T without forming creases on the first side 9 on which the printing area 5 is formed and applies a holding force so as to suppress the printing material T from being displaced during textile printing or transportation of the printing material T.

The connection structure 27 is disposed at the center of the underside of the second set tray 3 and has a shaft 37 that is fitted in a fitting hole 35 which is provided in the upper portion of a post 33 of a support table 31 in a transportation unit 17, which will be described later. The shaft 37 fitted in the fitting hole 35 is secured to the post 33, in this embodiment, by fastening a mounting bolt 39 and is removed from the post 33 by unfastening the mounting bolt 39.

The second set tray 3 is detachably mounted on the post 33 in the transportation unit 17 via the connection structure 27, in this embodiment, by using center alignment. The transportation unit 17 includes a support base 29 that extends in a transportation direction A from the front to the back side of the apparatus body 2 of the ink jet textile printing apparatus 1, a slider 30 that is disposed above and at the center in the left-right direction of the support base 29 and is movable in the transportation direction A, a support table 31 that has the post 33 of a predetermined height, and a drive mechanism that uses a timing belt 43 as an example for driving the support table 31.

The second set tray 3 can reciprocate by using the transportation unit 17 between a set position S which is provided in front of the position where the printing material T is set and a textile printing starting position K which is a position that the second set tray 3 reaches when it moves beyond a textile printing performing area 15. The ink ejection head 13 is mounted on a carriage 21 that reciprocates in a scan direction B which is a width direction of the apparatus body 2 and intersects the transportation direction A of the printing material T. The respective colors of ink C are supplied to the ink ejection head 13 via tubes or the like from an ink cartridge 41 which is disposed on the left to the apparatus body 2, for example.

2. Pretreatment Method for Printing Material (See FIG. 8 and FIGS. 4 to 7)

The pretreatment method for a printing material according to the invention is a pretreatment method to apply an ink permeation inhibiting property to the printing material T prior to performing ink jet textile printing on the printing material T by the ink jet textile printing apparatus 1. Specifically, the pretreatment method is performed by using a pretreatment device 51 such as that shown in FIG. 8. The pretreatment device 51 is configured to perform imparting a tension force F to at least the printing area 5 of the printing material T on which ink jet textile printing is performed so as to change the printing area 5 from its natural state into a tensioned state, and applying a pretreatment agent M having an ink permeation inhibiting property on the printing area 5 in the tensioned state.

The pretreatment agent M having an ink permeation inhibiting property may be various known agents such as those of quick-drying type and post-curing type which are cured or dried by subsequently applying heat or light. For example, the pretreatment agent M may include those containing multivalent metal salt, water-dispersible resin, water and surfactant. The water-dispersible resin may include resin emulsion of anionic resin having urethane backbones, polyether type urethane resin having ether bonds in the main chain, polyester type urethane resin having ester bonds in the main chain, carbonate type urethane resin having carbonate bonds in the main chain and the like. The pretreatment agent M may include a pretreatment agent containing dipropylene glycol monopropyl ether and a cationic substance. The hardness of the pretreatment agent M after solidified may be sufficient as long as it can function as a pretreatment layer. For example, in the case of the pretreatment agent M which is thermally dried and solidified, it may not be completely dried. Means for applying the pretreatment agent M may include a roller and spray, for example.

Figure 8:
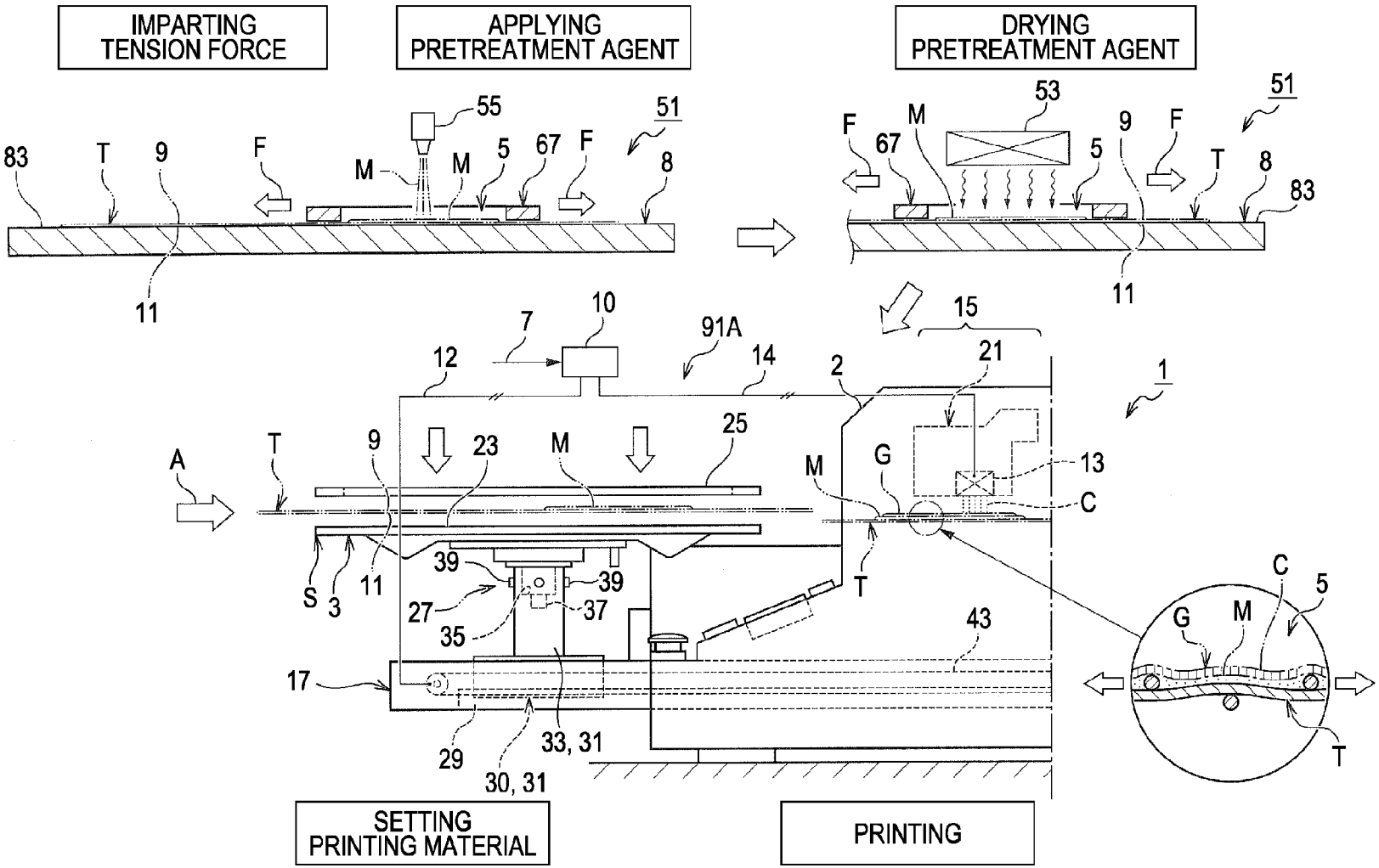
FIG. 8 is a side sectional view showing an example of performing ink jet textile printing on a printing material that has been pretreated by the pretreatment method for a printing material according to the invention.

In order to accommodate the above-mentioned post-curing pretreatment agent M, the pretreatment device 51, as shown in FIG. 8, includes a drying device 53 that dries the pretreatment agent M which has been applied on the printing area 5 is disposed at a stage after an applying device 55 that applies the pretreatment agent M on the printing area 5. Accordingly, the pretreatment method for a printing material using the drying device 53 is configured to include, after applying the pretreatment agent, drying the pretreatment agent M having an ink permeation inhibiting property that has been applied on the printing area 5.

In imparting the tension force F, the tension force F is applied to at least a pair of opposing left and right sides 57, 59 or front and rear sides 61, 63 of the printing area 5. The structure for imparting such a tension force can be achieved simply by using a fitting structure of the frame body 25 of FIG. 1. In addition to that, it is possible to use, for example, tension imparting structures 65A, 65B, 65C, 65D which are shown in FIGS. 4 to 7. Details of the four types of tension imparting structures 65A, 65B, 65C, 65D shown in FIGS. 4 to 7 will be described below.

A. First Tension Imparting Structure (See FIGS. 4*a* and 4*b*)

Figure 4A:
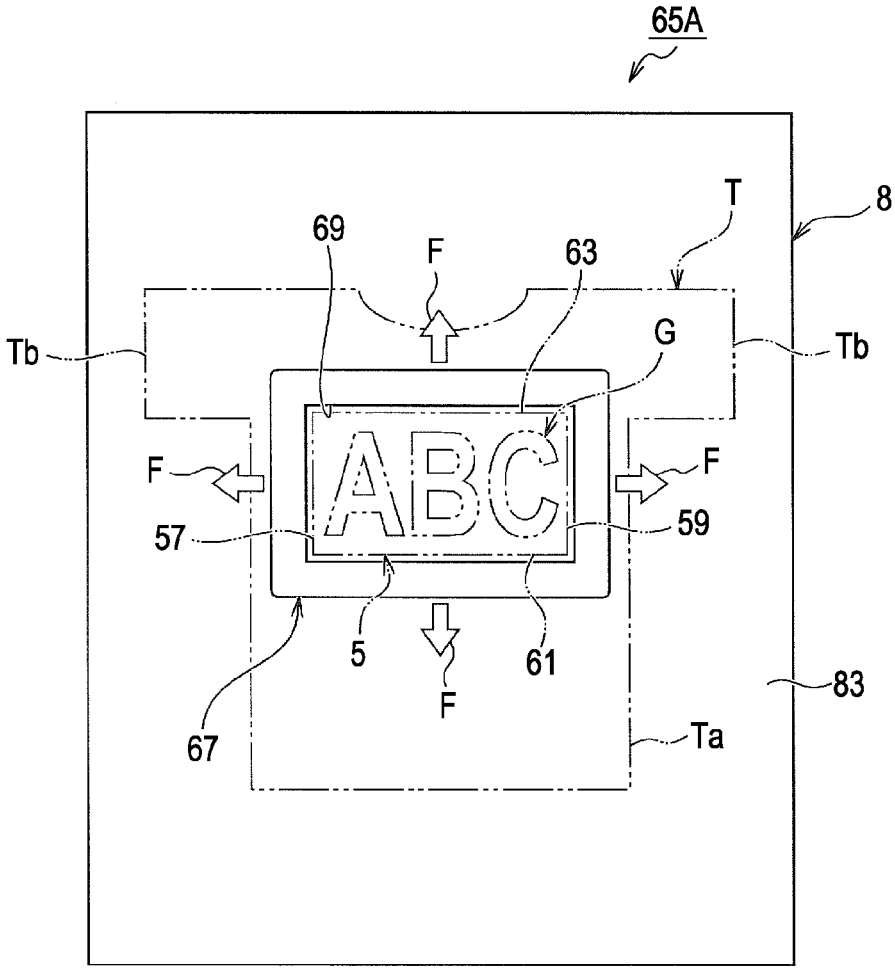
FIG. 4A is a plan view of an example of a tension imparting structure used in a pretreatment method for a printing material according to the invention.

FIG. 4A is a plan view of the tension imparting structure 65A in which the tension force F is applied to the opposing left and right sides 57, 59 and front and rear sides 61, 63 of the printing area 5. The tension imparting structure 65A is configured such that a rectangular frame 67 is downwardly pressed against the printing material T which is spread on a set surface 83 of a first set tray 8 for pretreatment, thereby holding the four sides 57, 59, 61, 63 of the printing area 5 between the frame 67 and the set surface 83.

The frame 67 used in the tension imparting structure 65A may be made of various materials (for example, rubber) or made in various configurations (for example, concave-convex configuration) that applies a frictional force so as to prevent the printing material T which is held in the state of being outwardly pulled from shrinking back to its original state. Means for imparting a pressing force to the frame 67 may be various pressing force imparting means, including those use the weight of the frame 67 itself, those use a biasing member such as a compression coil spring, and those of mechanical type using a clamp mechanism.

In the tension imparting structure 65A having the above described configuration for imparting the tension force F to the printing material T, the printing material T is first set on the set surface 83 of the first set tray 8, and then, the frame 67 is placed on the printing material T with a slight press. Then, the printing material T is pulled outward by using, for example, a plate member to remove creases on the portion of the first side 9 of the printing material T which is exposed though a window 69 of the frame 67. Next, the frame 67 is put into a normal press state for applying a specific holding force so that the four sides 57, 59, 61, 63 of the printing area 5 are held in the state of being outwardly pulled with a specific tension force F.

Figure 4B:
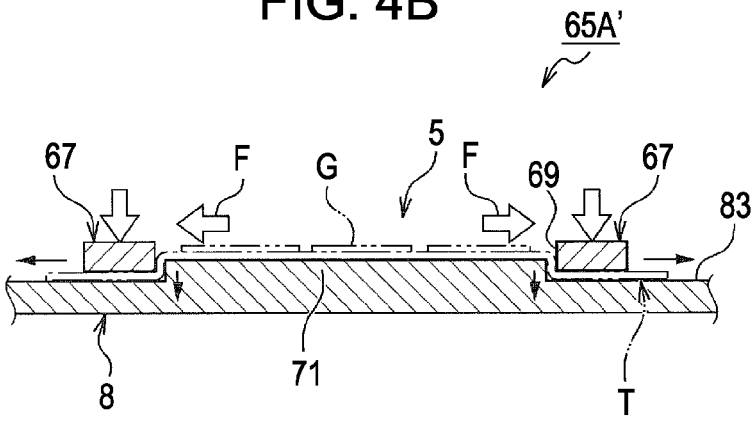
FIG. 4B is a vertical sectional front view of a variation of the tension imparting structure of FIG. 4A.

As shown in FIG. 4B, a variation of the tension imparting structure 65A is possible by providing a convex portions 71 on the set surface 83 of the first set tray 8 so as to fit into the window 69 of the frame 67. With this configuration of the tension imparting structure 65A', when the frame 67 is pressed against the printing area 5, an outward tension force F is also applied to the printing area 5 due to the height of the convex portions 71. Accordingly, it is possible to eliminate or alleviate the operation of removing creases by using, for example, a plate member.

B. Second Tension Imparting Structure (See FIG. 5)

Figure 5:
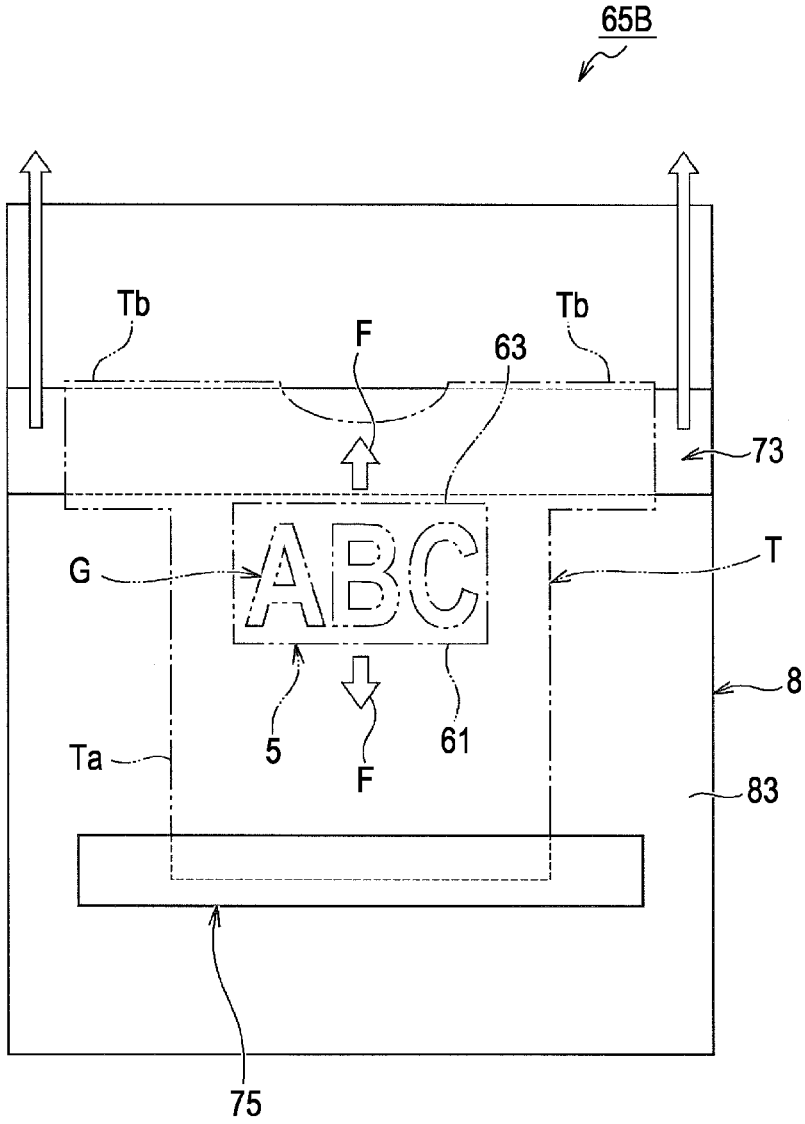
FIG. 5 is a plan view of another example of the tension imparting structure used in the pretreatment method for a printing material according to the invention.

FIG. 5 is a plan view of the tension imparting structure 65B in which the tension force F is applied only to the opposing front and rear sides 61, 63 of the printing area 5. The tension imparting structure 65B is configured to include a movable tensioning member 73 that is used to be placed through the left and right sleeves Tb, Tb of the printing material T which is set on the set surface 83 of the first set tray 8 and is movable in the front-back direction, and a press holding member 75 that holds the lower edge of the torso Ta of the printing material T.

The movable tensioning member 73 for use in the tension imparting structure 65B may include a rectangular plate member having a longer dimension in the width direction such as that shown in the figure and any member formed in the shape of a clothes hanger. A mechanism for moving the movable tensioning member 73 in the front-back direction may be various moving mechanisms, including those use a weight connected to the movable tensioning member 73 via a wire, and those use a biasing member such as a tension coil spring.

The press holding member 75 may be made of the same material or made in the same configuration as that of the frame 67 of the first tension imparting mechanism 65A. Further, Means for imparting a pressing force to the press holding member 75 may include the same pressing force imparting means as that is used for the frame 67 of the first tension imparting structure 65A.

In the tension imparting structure 65B having the above described configuration for imparting the tension force F to the printing material T, the printing material T is first set on the set surface 83 of the first set tray 8, and then, the press holding member 75 is downwardly pressed against the lower end of the torso Ta of the printing material T so as to hold the lower end of the torso Ta between press holding member 75 and the set surface 83. Next, the movable tensioning member 73 is inserted to extend through the sleeves, by entering from one of the sleeves Tb and exiting the other of the sleeves Tb. The movable tensioning member 73 is moved by a moving mechanism in a direction by which the tension force F is applied to the printing area 5 so that the opposing front and rear sides 61, 63 of the printing area 5 are held in the state of being outwardly pulled with a specific tension force F.

C. Third Tension Imparting Structure (See FIG. 6)

Figure 6:
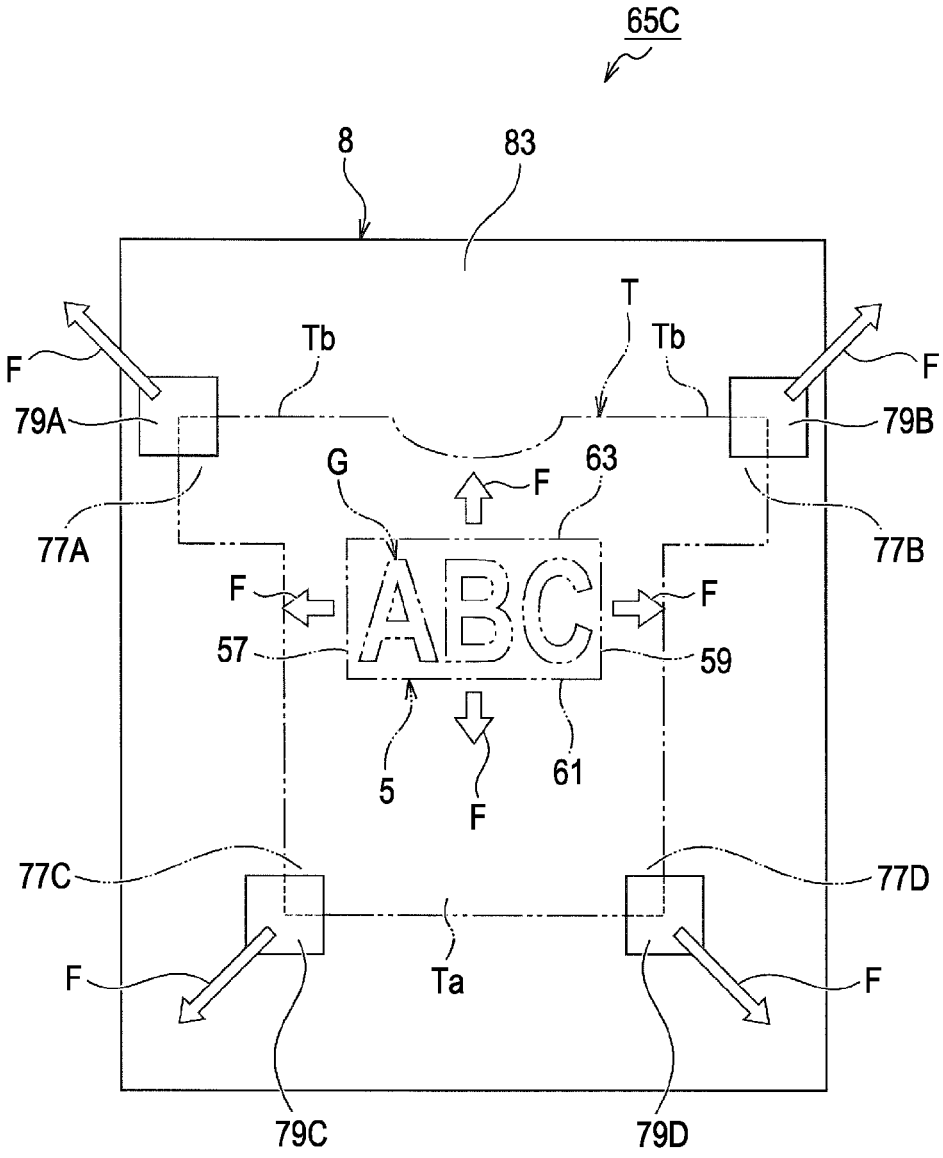
FIG. 6 is a plan view of another example of the tension imparting structure used in the pretreatment method for a printing material according to the invention.

FIG. 6 is a plan view of the tension imparting structure 65C in which the tension force F in the radially outward direction is applied to four corners 77A, 77B, 77C, 77D of the printing material T. The tension imparting structure 65C is configured to include four holding clips 79A, 79B, 79C, 79D that pinch and hold the four corners 77A, 77B, 77C, 77D of the printing material T, respectively.

A mechanism for moving the four holding clips 79A, 79B, 79C, 79D in the radially outward direction may include the same mechanism as that is used for moving the movable tensioning member 73 of the second tension imparting structure 65B. When the four holding clips 79A, 79B, 79C, 79D are moved in the radially outward direction, each of the opposing left and right sides 57, 59 and opposing front and rear sides 61, 63 of the printing area 5 is subject to the outward tension force F.

D. Fourth Tension Imparting Structure (See FIG. 7)

Figure 7:
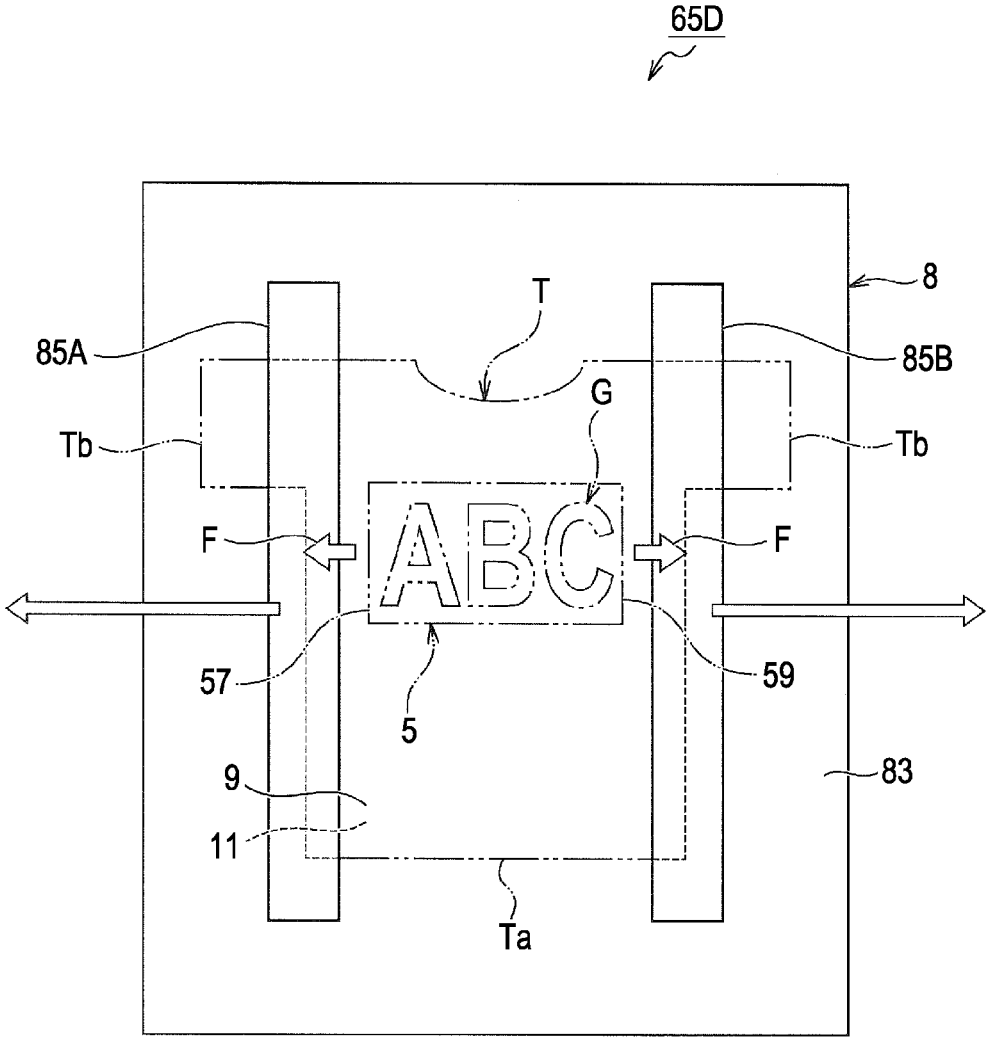
FIG. 7 is a plan view of another example of the tension imparting structure used in the pretreatment method for a printing material according to the invention.

FIG. 7 is a plan view of the tension imparting structure 65D in which the tension force F is applied only to the opposing left and right sides 57, 59 of the printing area 5. The tension imparting structure 65D is configured such that a pair of left and right movable tensioning members 85A, 85B is downwardly pressed against the printing material T which is set on the set surface 83 of the first set tray 8, thereby holding the printing material T between the movable tensioning members 85A, 85B and the set surface 83. When the movable tensioning members 85A, 85B are moved in a direction apart from each other with the printing material T being held, the tension force F is applied to the printing area 5.

The movable tensioning members 85A, 85B may include a rectangular plate member having a longer dimension in the front-back direction. Further, when the movable tensioning members 85A, 85B are moved outward while being pressed against the left and right side ends of the first side 9 of the printing material T, the movable tensioning members 85A, 85B must apply a frictional force so as to prevent the printing material T from shrinking back to its original state. Specifically, a rubber material may be affixed to or a concave-convex texture may be formed on a pressing surface of the movable tensioning members 85A, 85B in order to enhance the frictional force of the movable tensioning members 85A, 85B. Means for imparting a pressing force to the movable tensioning members 85A, 85B may be various pressing force imparting means, including those use the weight of the movable tensioning members 85A, 85B themselves with extra weight being added, and those use a biasing force of the movable tensioning members 85A, 85B which are made as a leaf spring having its center portion curved toward the printing material T.

A mechanism for moving the left and right movable tensioning members 85A, 85B in directions toward and away from each other may include the same mechanism as that is used for moving the movable tensioning member 73 of the second tension imparting structure 65B. In the tension imparting structure 65D having the above described configuration, the tension force F for pulling the opposing left and right sides 57, 59 of the printing area 5 in the outward direction is applied to the printing material T so that the printing material T are held in the state of being outwardly pulled with the tension force F.

Figure 9:
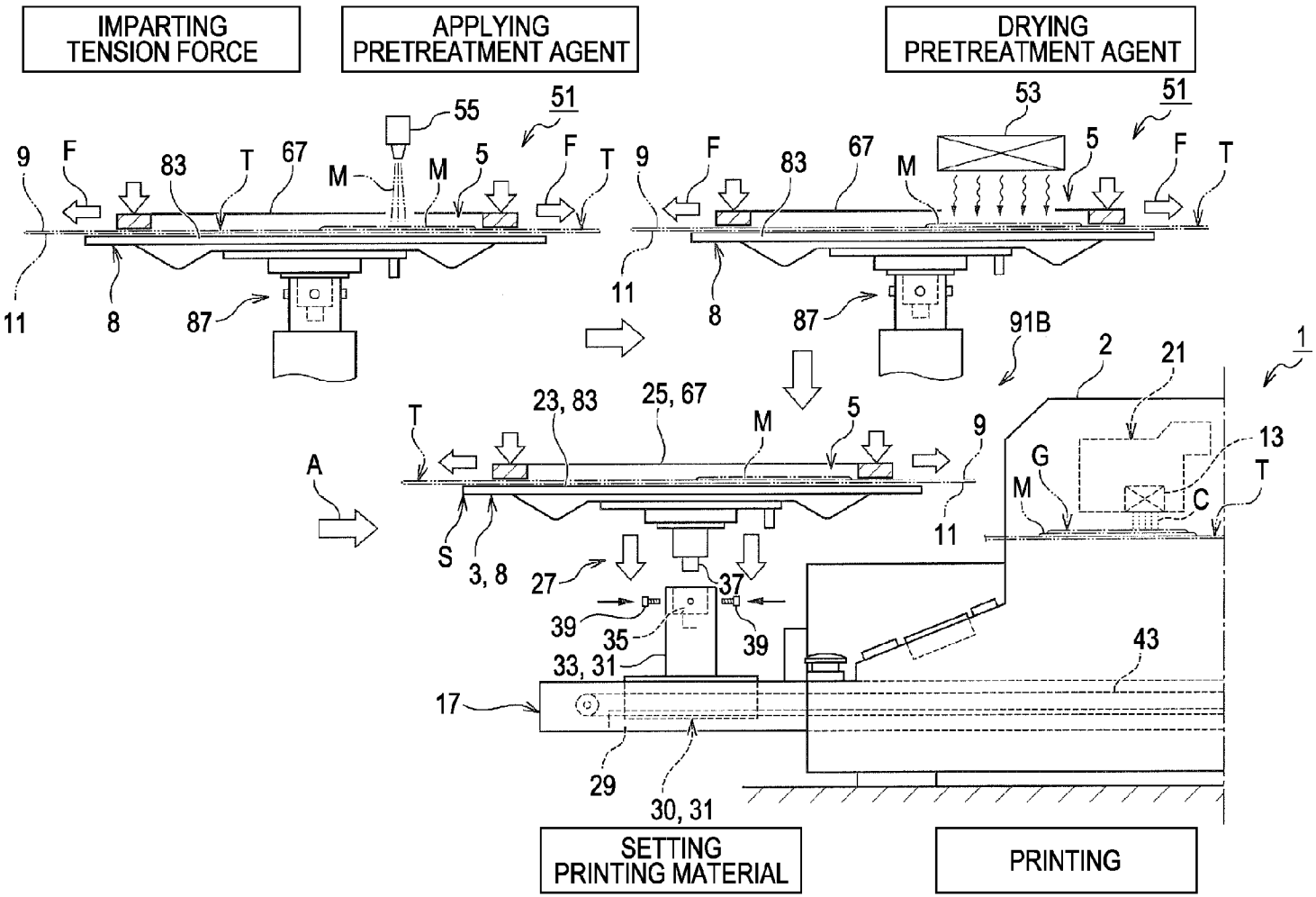
FIG. 9 is a side sectional view showing another example of performing ink jet textile printing on a printing material that has been pretreated by the pretreatment method for a printing material according to the invention.
Figure 10:
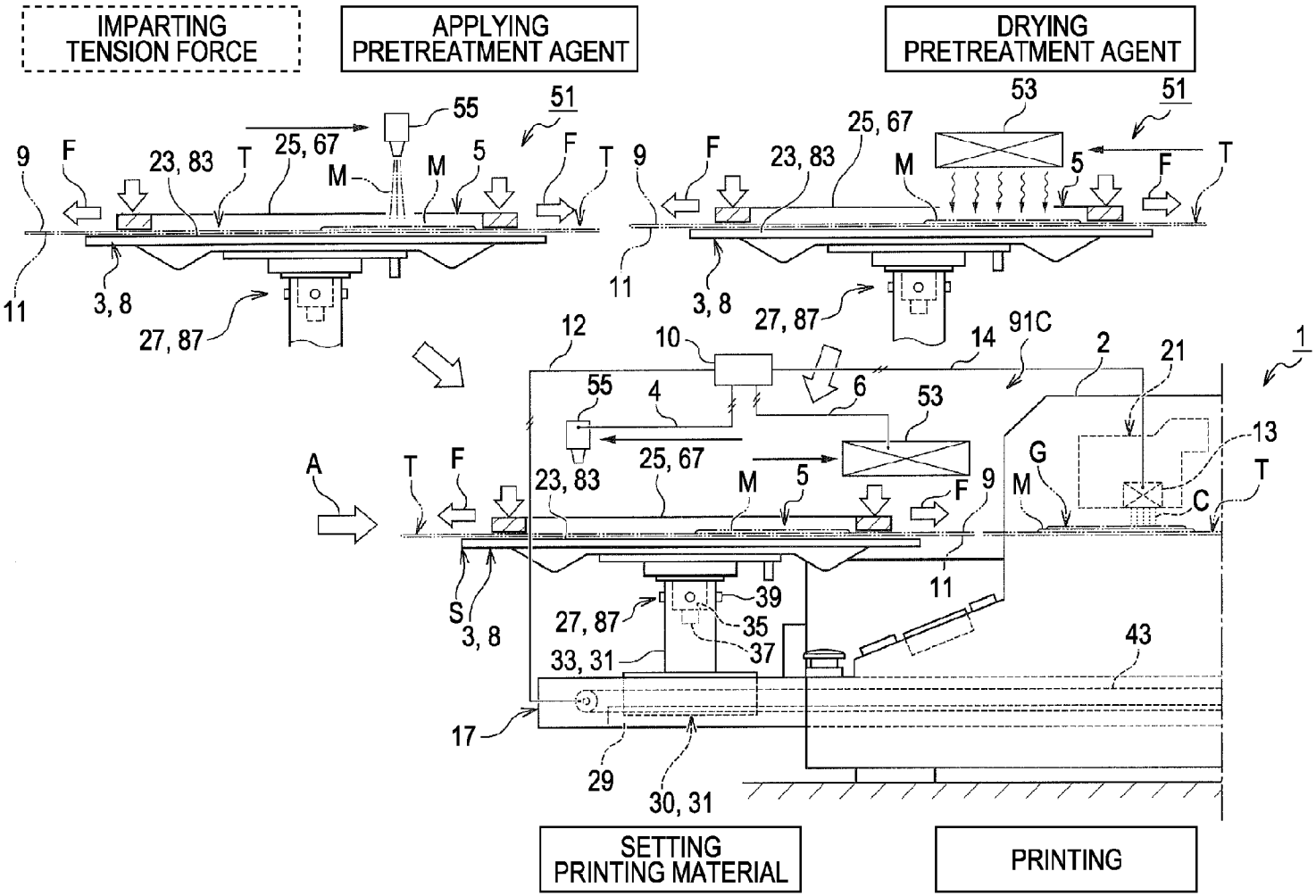
FIG. 10 is a side sectional view showing still another example of performing ink jet textile printing on a printing material that has been pretreated by the pretreatment method for a printing material according to the invention.
Figure 11A:
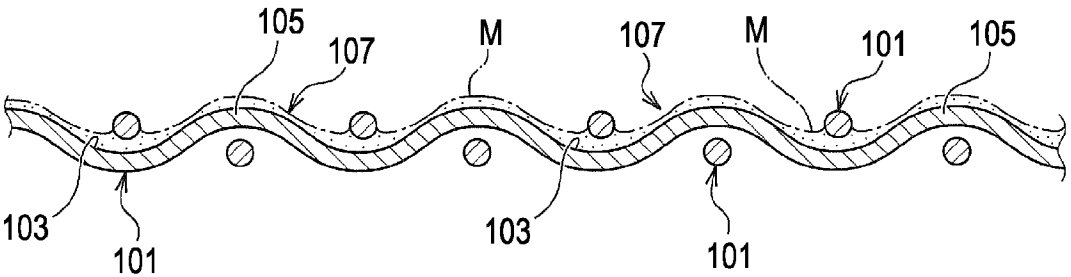
FIGS. 11A and 11B are side sectional views which show a problem of conventional pretreatment method for a printing material in two phases.
Figure 11B:
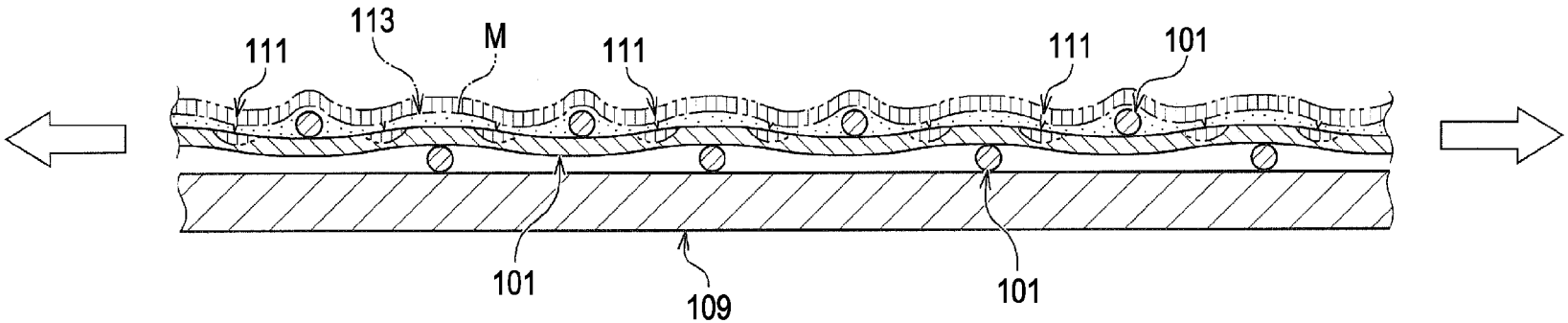

3. Description of Ink Jet Textile Printing Method and Ink Jet Textile Printing Apparatus (See FIGS. 8 to 10)

An example of the ink jet textile printing method according to the invention is used when ink jet textile printing of the printing image G is performed on the printing material T on which the pretreatment agent M having an ink permeation inhibiting property has been applied. The ink jet textile printing method includes setting the printing material T on which the pretreatment agent M has been applied on the second set tray 3 of the ink jet textile printing apparatus 1 after applying the pretreatment agent by the pretreatment method for a printing material, or after drying the pretreatment agent in the case where drying the pretreatment agent is included, and performing textile printing for forming a desired printing image G by ejecting respective colors of ink C onto the printing area 5 of the printing material T which has been set on the second set tray 3.

The configuration of the above-mentioned ink jet textile printing method is characterized in that the pretreatment method for a printing material includes imparting of the tension force as described above and a feeding form of the printing material T in which the printing material T which has been pretreated by using the pretreatment method for a printing material is fed to setting of the printing material. In the following description, the description of the above-mentioned imparting of the tension force will be omitted, and the feeding form of the printing material T, which is another feature of the configuration of the invention, and the configuration of details of the ink jet textile printing apparatus 1 according to each feeding form will be described.

A. First Feeding Form (See FIG. 8)

A first feeding form 91A is a feeding form that is used when the pretreatment device 51 and the ink jet textile printing apparatus 1 are independent from each other and separately provided. The ink jet textile printing apparatus 1 having this form includes the ink ejection head 13 that performs ink jet textile printing on the printing material T, the second set tray 3 that has the set surface 23 on which the printing material T is set and performs a relative movement to the ink ejection head 13 during performing ink jet textile printing, and a control unit 10 that controls each operation of the ink ejection head 13 and the relative movement. The control unit 10 has a control mode to send control signals 12, 14 when receiving information that indicates that a pretreatment agent having an ink permeation inhibiting property has been applied on the printing area T in the tensioned state and start ink jet textile printing by the ink ejection head 13.

In this embodiment, after applying the pretreatment agent or drying the pretreatment agent by using the pretreatment device 51, the tension force F imparted to the printing material T is released and the printing material T which has been set on the first set tray 8 of the pretreatment device 51 is removed. The printing material T which has been pretreated is then set on the second set tray 3 of the ink jet textile printing apparatus 1 to perform ink jet textile printing on the printing material T.

Figure 12:
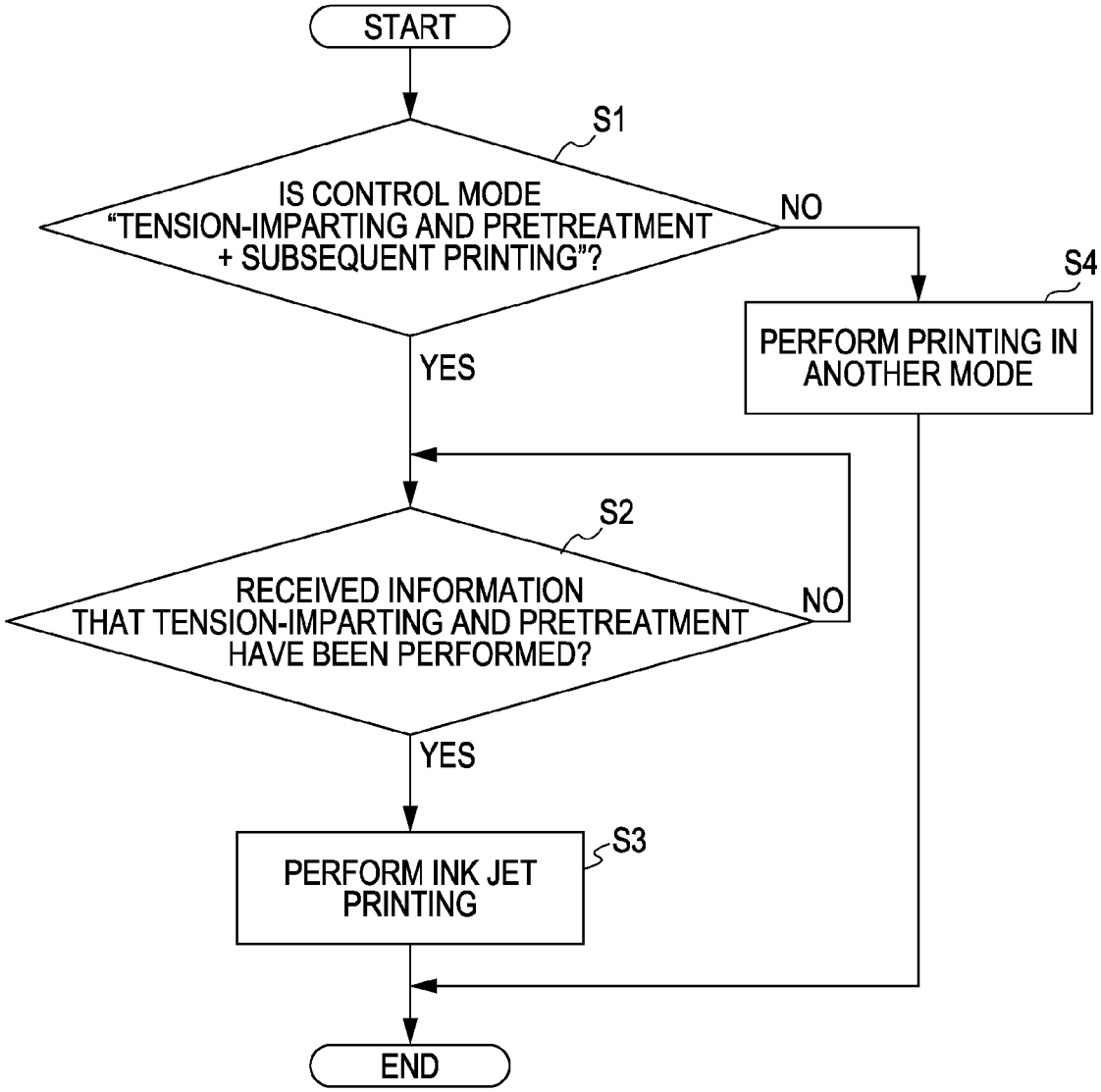
FIG. 12 is a flow diagram which shows control of the ink jet textile printing apparatus of FIGS. 8 and 9.

With reference to a flow diagram of FIG. 12, the operation of the control unit 10 during ink jet textile printing will be described. First, it is determined in step S1 whether or not the control mode of textile printing is currently selected by a user to apply the pretreatment agent on the printing area 5 of the printing material T in the state that the tension force is imparted to the printing area 5, and then to perform ink jet textile printing on the printing material T on which the pretreatment agent has been applied as above mentioned. If the decision at step S1 is "Yes", it is then determined in step S2 whether or not information 7 that indicates that imparting of the tension force and pretreatment have been performed is received. The information 7 is obtained, in this embodiment, from a user inputting via an operation panel. On receiving the information 7, ink jet textile printing is started in step S3. If the information 7 is not received, ink jet textile printing is not started. This enables to reduce a risk of unintentionally performing the textile printing of this control mode on the printing material T without performing imparting of the tension force and pretreatment. If the decision at step S1 is "No", textile printing in another mode is performed in step S4.

In this embodiment, the printing material T is set on the second set tray 3 during setting of the printing material while a tension force is applied to the printing area 5 to the same extent as the tension force F imparted during imparting of the tension. In performing of the textile printing, ink jet textile printing is performed in a state that the tension force which has been imparted during setting of the printing material is applied. With this configuration, the tensioned states of the printing area 5 during application of the pretreatment agent M and during ejection of the ink C to form the printing image G are substantially the same, thereby improving the quality of the printing image G.

B. Second Feeding Form (See FIG. 9)

A second feeding form 91B is a feeding form that achieves smooth feeding from the pretreatment device 51 to the ink jet textile printing apparatus 1 by providing the second set tray 3 of the ink jet textile printing apparatus 1 as the same set tray as the first set tray 8 of the pretreatment device 51. In addition to this, the connection structure 27 for the second set tray 3 of the ink jet textile printing apparatus 1 has the same configuration as that of the connecting structure 87 for the first set tray 8 of the pretreatment device 51. That is, the second set tray 3 is detachably mounted to the support table 31, which is a connected member, and performs a relative movement to the ink ejection head 13 during performing ink jet textile printing while being mounted on the support table 31. The control unit 10 controls each operation of the ink ejection head 13 and the relative movement. Further, the second set tray 3 is configured to also serve as the first set tray 8 when the first set tray 8 of the pretreatment device 51 is removed from the pretreatment device 51. With this configuration, imparting of the tension, applying of the pretreatment agent, setting of the printing material and performing of the textile printing can be performed using a single set tray. In this embodiment, the operation of the control unit 10 in performing ink jet textile printing is the same as that described in the embodiment of the FIG. 8 and the description and illustration thereof will be omitted.

According to the configuration of the second feeding form 91B, application of the pretreatment agent M and ink jet textile printing to form the printing image G can be performed while maintaining a specific tension force that has been imparted to the printing area 5 during imparting of the tension, thereby further improving the quality of the printing image G and facilitating a setting operation of the printing material T during setting of the printing material.

C. Third Feeding Form (See FIG. 10)

Figure 13:
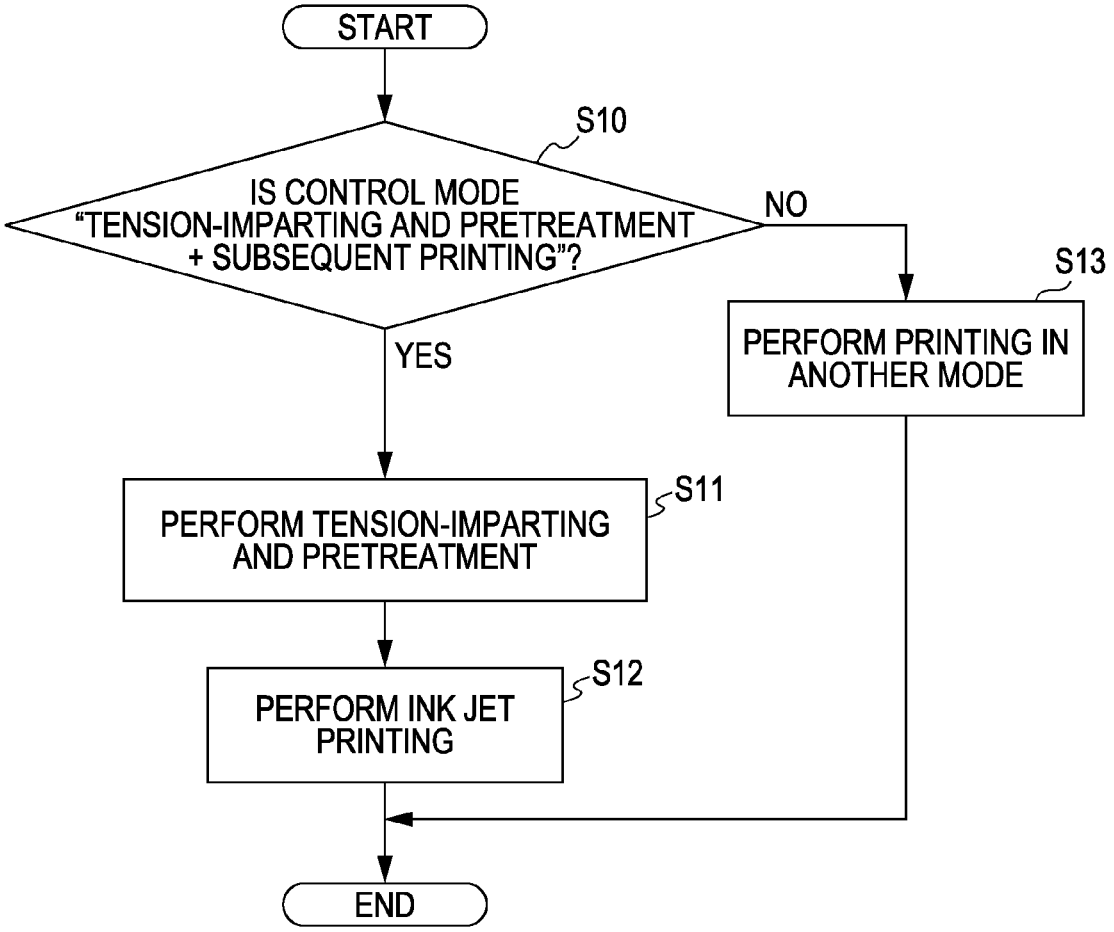
FIG. 13 is a flow diagram which shows control of the ink jet textile printing apparatus of FIG. 10.

A third feeding form 91C is a feeding form in which a mounting and removing operation of the first set tray 8 in the pretreatment device 51 is eliminated by performing pretreatment of the printing material T at the set position S in the ink jet textile printing apparatus 1. That is, the ink jet textile printing apparatus in this embodiment includes the ink ejection head 13, the second set tray 3, pretreatment device 51 that is configured such that the second set tray 3 also serves as the first set tray 8, the ink ejection head 13, and the control unit 10 that controls each operation of the relative movement and the pretreatment device 51. The control unit 10 has a control mode to perform ink jet textile printing by using the ink ejection head 13 after the pretreatment agent having an ink permeation inhibiting property is applied on the printing area in the tensioned state by the pretreatment device 51. According to the configuration of the third feeding form 91C, the pretreatment device 51 is integrated as a component of the ink jet textile printing apparatus 1. Accordingly, pretreatment of the printing material T and ink jet textile printing to form the printing image G can be performed by using only the second set tray 3 in a succession of operations. With reference to FIG. 13, the operation of control unit 10 in this embodiment in performing ink jet textile printing will be described. First, it is determined in step S10, whether or not the control mode of textile printing is currently selected by a user to apply the pretreatment agent on the printing area 5 of the printing material T in the state that the tension force is imparted to the printing area 5, and then to perform ink jet textile printing on the printing material T on which the pretreatment agent has been applied as above mentioned. If the decision at step S10 is "Yes", pretreatment is performed by the pretreatment device 51 in step S11 in the state that the tension force is imparted. Then, ink jet textile printing is started in step S12. If the decision at step S10 is "No", textile printing in another mode is performed in step S13.

According to the configuration of the third feeding form 91C, pretreatment can be performed while imparting a specific tension force F on the printing area 5 of the printing material T at the same time of setting the printing material T on the second set tray 3, and therefore imparting the tension force and setting the printing material are performed at the same time. Accordingly, in addition to smooth feeding of the printing material T, it is possible to shorten the operations and prevent displacement and changes in tensioned state of the printing material T during feeding in each operation.

Other Embodiments

The pretreatment method for a printing material, the pretreatment device, the ink jet textile printing method and the ink jet textile printing apparatus 1 according to the invention essentially include the above described configuration. However, it is needless to say that part of the configuration can be changed or omitted without departing from the spirit of the invention. For example, in imparting the tension force by the pretreatment method for a printing material, the tension force F may be imparted to the entire printing material T or only the printing area 5 on which ink jet textile printing is actually performed. The timing when tension force F is imparted to the printing area 5 may be slightly before the timing when the pretreatment agent M is applied, or may be the same.

The configuration of a tension imparting structure 65 may not be limited to the above described four tension imparting structure 65A, 65B, 65C, 65D, and various configurations of the tension imparting structure 65 may be used. For example, in the case where the printing material T is a T-shirt, in the tension imparting structure 65, a supplementary set tray in a T-shirt shape slightly larger than the printing material T may be provided so that the tension force F is imparted to the T-shirt by stretching the T-shirt so as to cover the set tray. A configuration that uses a rotating member such as a roller or a needle-shaped member may also be used to impart the tension force F to the T-shirt.

Although the directions of the tension force F imparted to the printing area 5 are effective when applied to the opposing two sides, the directions may not be necessarily the opposing two sides, and various directions that can reduce creases on the printing area 5 may also be used. Further, the number of directions of the tension force F is not limited to the above-mentioned one or two directions, and the tension force F may be imparted in more number of directions. In addition, the ink ejection head 13 used in the ink jet textile printing apparatus 1 or the ink jet textile printing method according to the invention is not limited to a so-called serial type ink ejection head mounted on the carriage 21 which reciprocates in the scan direction B, and may be a so-called line type ink ejection head which does not use the carriage 21 and is capable of printing in the entire width of the printing area 5 at a time. The relative movement between the second set tray 3 and the ink ejection head 13 is not limited to the configuration of the above embodiment in which the second set tray is relatively moved. Other configuration in which the ink ejection head 13 is relatively moved, or alternatively, both the second set tray 3 and the ink ejection head 13 are moved relative to each other may also be used.

The entire disclosure of Japanese Patent Application No. 2011-209185, filed Sep. 26, 2011 is expressly incorporated by reference herein.

What is claimed is:

1. An ink jet textile printing apparatus comprising:

a set tray on which a printing material is set, an ink ejection head that ejects ink toward the printing material which is set on the set tray;

a tension force imparting unit that imparts a tension force to at least a printing area of the printing material;

a pretreatment agent applying unit that applies a pretreatment agent having an ink permeation inhibiting property on at least the printing area of the printing material which is set on the set tray in the tensioned state; and a control unit that controls at least one of operations of the ink ejection head, the tension force imparting unit and the pretreatment agent applying unit, wherein the control unit has a control mode to start ink jet textile printing by the ink ejection head when receiving information that indicates that the pretreatment agent has been applied by the pretreatment agent applying unit.

2. The ink jet textile printing apparatus according to claim 1, wherein the tension force imparting unit includes a frame unit that is fitted to the set tray.

3. The ink jet textile printing apparatus according to claim 1, wherein the tension force imparting unit includes a convex portion that is located on the set tray.

4. The ink jet textile printing apparatus according to claim 1, wherein the tension force imparting unit includes a movable tensioning member that is moved relative to the printing material contacting with the printing material.

5. The ink jet textile printing apparatus according to claim 4, wherein the movable tensioning member includes a plate member.

6. The ink jet textile printing apparatus according to claim 4, wherein the movable tensioning member includes a clip that holds the printing material.

7. The ink jet textile printing apparatus according to claim 4, wherein the movable tensioning member includes a rotating member.

8. The ink jet textile printing apparatus according to claim 1, wherein a first tension force being applied to at least the printing area of the printing material when ink jet textile printing is performed is same a second tension force being applied to at least the printing area of the printing material when the pretreatment agent is applied.

9. An ink jet textile printing apparatus comprising:

a set tray on which a printing material is set, an ink ejection head that ejects ink toward the printing material which is set on the set tray;

a tension force imparting unit that imparts a tension force to at least a printing area of the printing material;

a pretreatment agent applying unit that applies a pretreatment agent having an ink permeation inhibiting property on at least the printing area of the printing material which is set on the set tray in the tensioned state; and a control unit that controls at least one of operations of the ink ejection head, the tension force imparting unit and the pretreatment agent applying unit, wherein the control unit has a control mode to start ink jet textile printing by the ink ejection head after the pretreatment agent has been applied by the pretreatment agent applying unit.

10. The ink jet textile printing apparatus according to claim 9, wherein the tension force imparting unit includes a frame unit that is fitted to the set tray.

11. The ink jet textile printing apparatus according to claim 9, wherein the tension force imparting unit includes a convex portion that is located on the set tray.

12. The ink jet textile printing apparatus according to claim 9, wherein the tension force imparting unit includes a movable tensioning member that is moved relative to the printing material contacting with the printing material.

13. The ink jet textile printing apparatus according to claim 12, wherein the movable tensioning member includes a plate member.

14. The ink jet textile printing apparatus according to claim 12, wherein the movable tensioning member includes a clip that holds the printing material.

15. The ink jet textile printing apparatus according to claim 12, wherein the movable tensioning member includes a rotating member.

16. The ink jet textile printing apparatus according to claim 9, wherein a first tension force being applied to at least the printing area of the printing material when ink jet textile printing is performed is same a second tension force being applied to at least the printing area of the printing material when the pretreatment agent is applied.

* * * * *